US009526996B1

(12) United States Patent
Chin

(10) Patent No.: US 9,526,996 B1
(45) Date of Patent: Dec. 27, 2016

(54) SLIDE ASSEMBLY

(71) Applicant: T. K. CHIN COMPANY LTD., Taipei (TW)

(72) Inventor: Howard Chin, Taipei (TW)

(73) Assignee: T. K. CHIN COMPANY LTD., Taipei (TW)

( * ) Notice: Subject to any disclaimer, the term of this patent is extended or adjusted under 35 U.S.C. 154(b) by 0 days.

(21) Appl. No.: 14/929,662

(22) Filed: Nov. 2, 2015

(30) Foreign Application Priority Data

Sep. 10, 2015 (TW) ..... 104129878 A

(51) Int. Cl.
*A63G 21/02* (2006.01)
*A63B 1/00* (2006.01)

(52) U.S. Cl.
CPC ..... *A63G 21/02* (2013.01)

(58) Field of Classification Search
CPC ..... A63G 21/00; A63G 21/02; A63G 21/04; A63B 1/00; A63B 1/005; B60P 7/00; B60P 7/15
USPC ..... 472/116–117; 482/38, 40; 211/123; 248/200.1
See application file for complete search history.

(56) References Cited

U.S. PATENT DOCUMENTS 1,891,588 A * 12/1932 Claus ..... A47L 3/00 160/338
2,270,909 A * 1/1942 Spizer ..... A63G 21/02 182/49
2,594,605 A * 4/1952 Zoppelt ..... A47H 1/022 211/123
2,839,299 A * 6/1958 Weiss ..... A63B 1/005 297/118
3,090,600 A * 5/1963 Smith ..... B60P 7/15 248/200.1
3,525,521 A * 8/1970 Sylvester ..... A63B 1/005 482/40
3,836,174 A * 9/1974 Holman, Jr. ..... B60P 7/15 211/105.6
8,771,093 B2 * 7/2014 Bowen ..... A63G 21/02 472/116

* cited by examiner

*Primary Examiner* — Kien Nguyen
(74) *Attorney, Agent, or Firm* — patenttm.us

(57) ABSTRACT

The slide assembly comprises a slide and at least one pushing unit. The slide has a platform and a sliding section. The at least one pushing unit is connected to the slide and has a connecting member, an adjusting member, two pushing blocks, and a securing member. The connecting member is securely mounted in the slide and two ends of the connecting member respectively extend out of the slide. The adjusting member is movably connected to one of the two ends of the connecting member and has multiple fastening portions spaced from each other. The two pushing blocks are respectively connected to the connecting member and the adjusting member. The securing member is selectively fastened with one of the fastening portions. The slide assembly is securely mounted on the stairway and has enhanced stability to reduce risk of playing on the slide.

7 Claims, 13 Drawing Sheets

SLIDE ASSEMBLY

CROSS-REFERENCE TO RELATED APPLICATIONS

This application is based upon and claims priority under 35 U.S.C. 119 from Taiwan Patent Application No. 104129878 filed on Sep. 10, 2015, which is hereby specifically incorporated herein by this reference thereto.

BACKGROUND OF THE INVENTION

1. Field of the Invention

The present invention relates to a slide assembly securely mounted on a stairway.

2. Description of the Prior Arts

Slide is a common entertainment facility. The conventional slide has a climbing ladder, a standing platform, and a slide section. The conventional slide is often placed in public places such as schools or parks for the general public. A compact indoor slide is developed for children, so the children do not need to play outdoors. The conventional indoor slide is mounted in an indoor space for children to play indoors. However, the conventional indoor slide occupies the indoor space and is located on the ground by its own weight, and the conventional plastic slide is not stably fixed on the ground. When children run or collide with each other in the indoor space, the indoor slide is easily bumped by the children to fall down. Thus, children are under risk when playing on the indoor slide.

To overcome the shortcomings, the present invention provides a slide assembly to mitigate or obviate the aforementioned problems.

SUMMARY OF THE INVENTION

The main objective of the present invention is to provide a slide assembly to be securely mounted with a stairway and has enhanced stability when mounted with the stairway.

The slide assembly comprises a slide and at least one pushing unit. The slide has a platform and a sliding section, and the sliding section is connected to the platform. The at least one pushing unit is connected to the slide and has a connecting member, an adjusting member, two pushing blocks, and a securing member. The connecting member is securely mounted through the slide and two ends of the connecting member respectively extend out of the slide. The adjusting member is movably connected to one of the two ends of the connecting member and has multiple fastening portions spaced from each other. The two pushing blocks are respectively connected to an outer end of the connecting member and an outer end of the adjusting member. The securing member is connected to the connecting member and selectively fastens with one of the fastening portions of the adjusting member.

The slide assembly in accordance with the present invention is applied to a stairway. According to a distance between two side walls of the stairway, the securing member is selectively fastened with one of the fastening portions to adjust the length of the adjusting member extending out of the slide, and the two pushing blocks of each one of the at least one pushing unit respectively abut the two side walls of the stairway. The present invention is securely mounted on the stairway by two pushing forces in opposite directions. The present invention has enhanced stability and reduces risk of playing on the slide.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
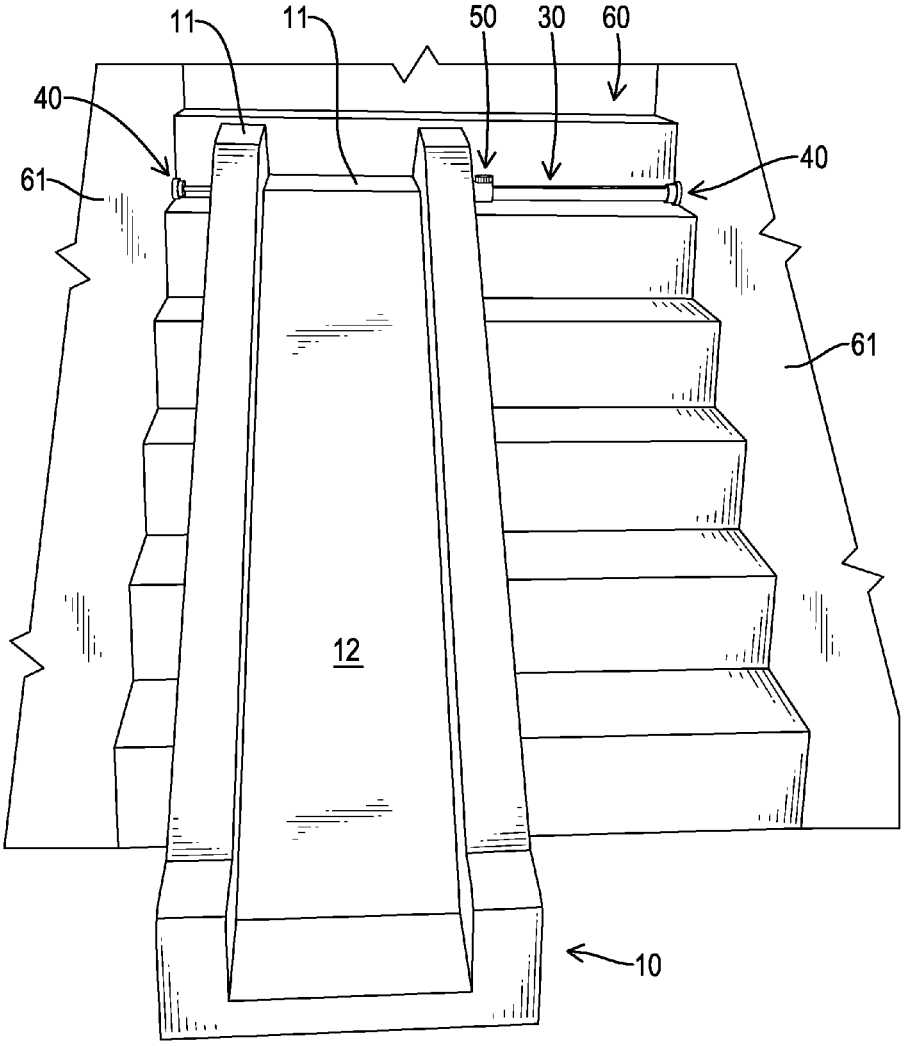
FIG. 1 is a perspective view of a first embodiment of a slide assembly in accordance with the present invention.
Figure 2:
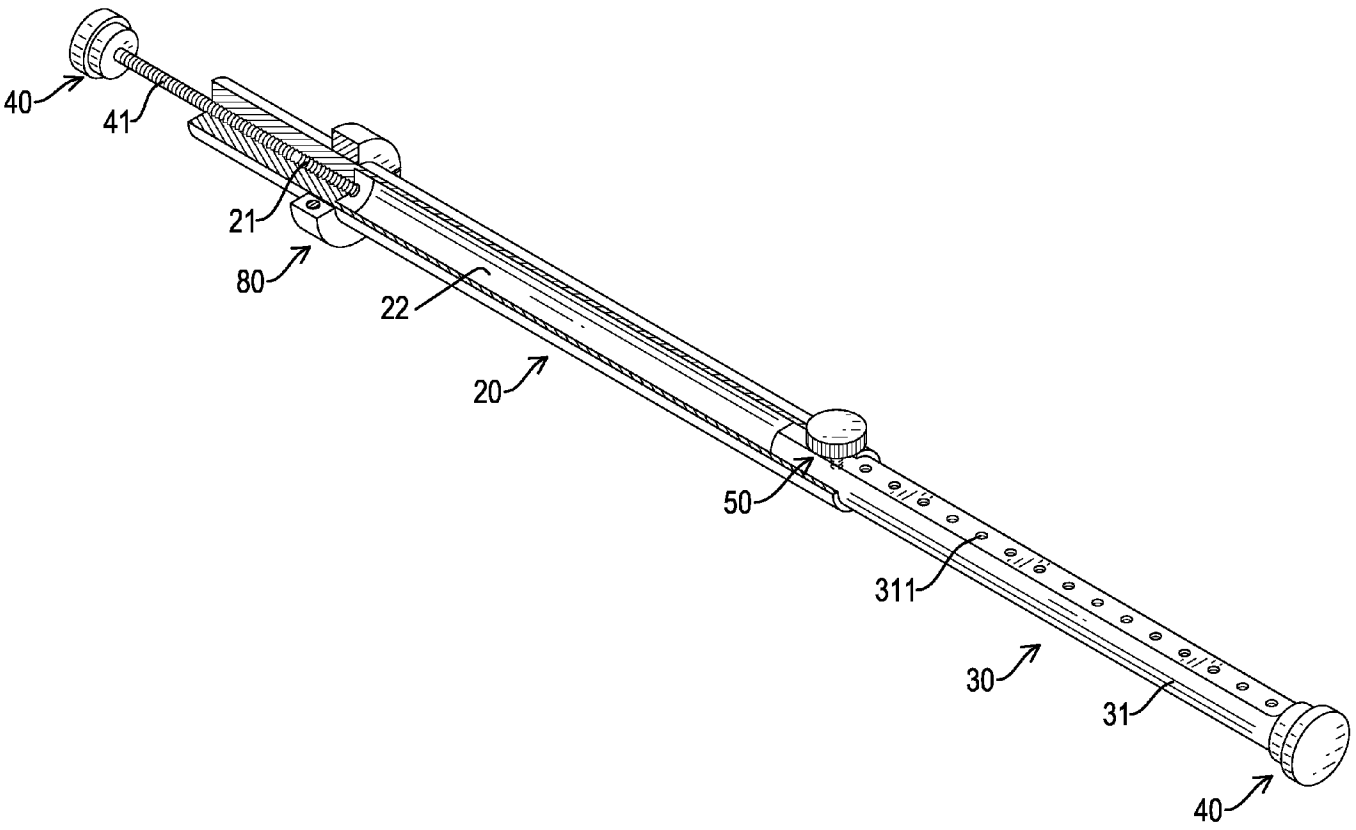
FIG. 2 is a connecting perspective view of a pushing unit of the slide assembly in FIG. 1.
Figure 3:
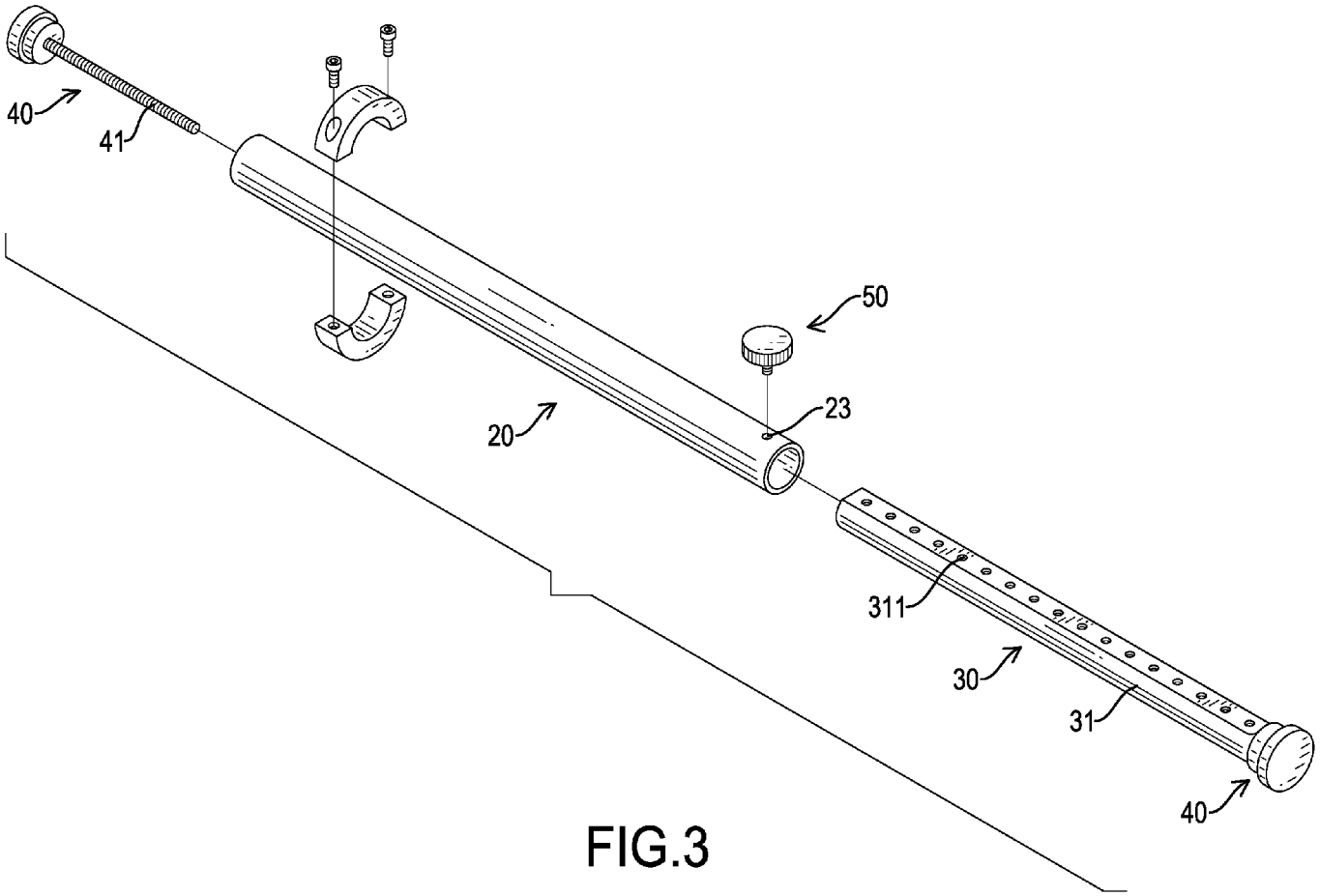
FIG. 3 is an exploded perspective view of the pushing unit of the slide assembly in FIG. 1.

With reference to FIGS. 1 and 2, a first embodiment of a slide assembly in accordance with the present invention comprises a slide 10 and a pushing unit. The pushing unit comprises a connecting member 20, an adjusting member 30, two pushing blocks 40, and a securing member.

The slide 10 has a platform 11 and a sliding section 12 connected to each other. The sliding section 12 is obliquely mounted on the platform 11, and a height difference between the sliding section 12 and the platform 11 gets bigger with the increase of an extending length of the sliding section 12. In a preferred embodiment, the slide is a combination structure, and the slide is combined with a platform and multiple sliding units.

Figure 13:
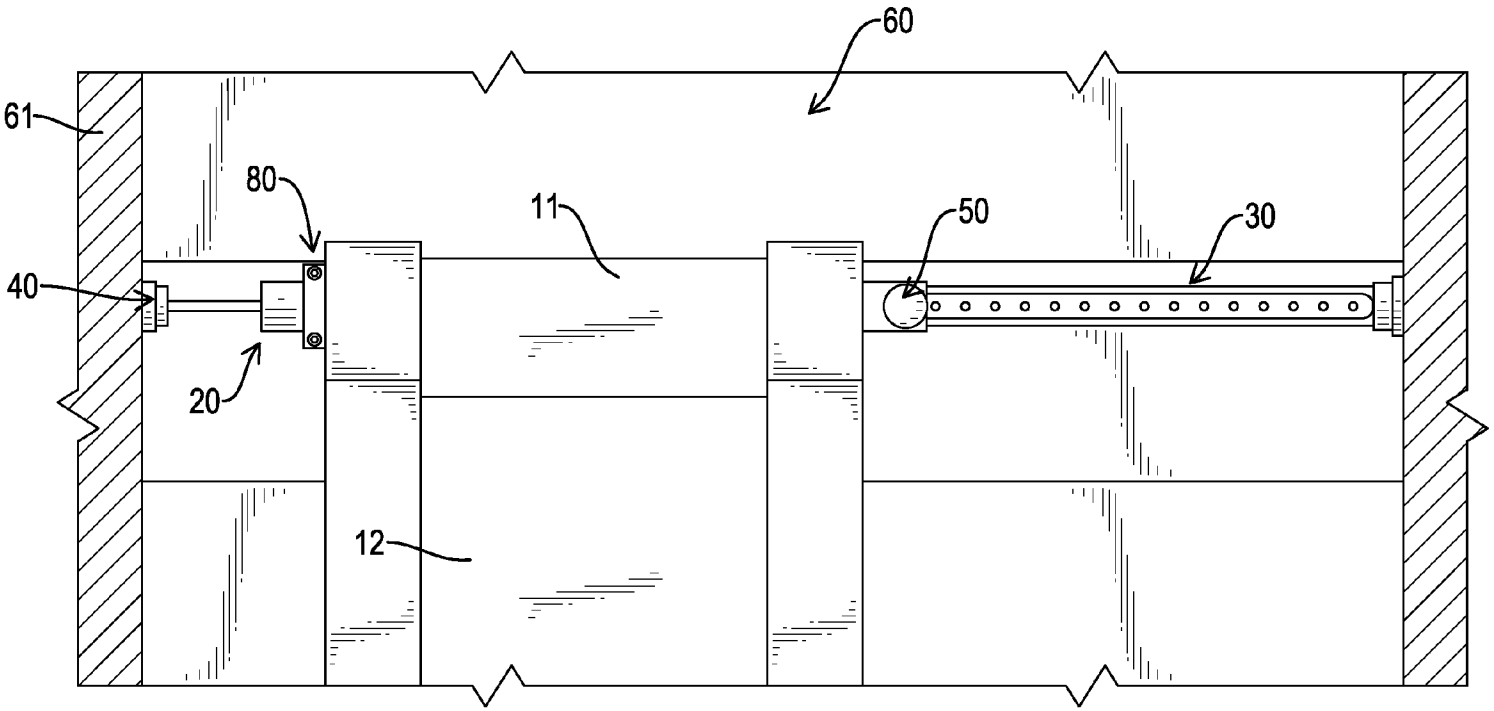
FIG. 13 is a plane view of the slide assembly in FIG. 6, showing the slide assembly mounted on a stairway.

The connecting member 20 is securely mounted in the platform 11 of the slide 10 and two ends of the connecting member 20 respectively extend out of the slide 10. With reference to FIGS. 1, 2 and 13, the connecting member 20 is mounted through the platform 11 of the slide 10 and is positioned by an external fixing ring 80 abutting on an outer wall of the platform 11. The two ends of the connecting member 20 respectively have a threaded hole 21 and a moving passage 22, and a top hole 23 is formed through the connecting member 20 and communicates with the moving passage 22.

The adjusting member 30 is a pole and has a rod body 31. The rod body 31 is movably mounted in the moving passage 22 of the connecting member 20 but is incapable of rotating relative to the moving passage 22 and has multiple fastening portions spaced from each other. In the first embodiment, the multiple fastening portions of the adjusting member 30 are multiple fixing threaded holes 311, and one of the multiple fixing threaded holes 311 selectively faces the top hole 23 of the connecting member 20.

The two pushing blocks 40 are respectively connected to an outer end of the connecting member 20 and an outer end of the adjusting member 30. In a preferred embodiment, each pushing block 40 of the pushing unit has a screw rod 41 perpendicularly and securely mounted on a side wall of the pushing block 40, and the pushing block 40 is screwed with the connecting member 20 or the adjusting member 30.

The securing member is a screw bolt 50, and the screw bolt 50 is mounted through the top hole 23 of the connecting member 20 and is selectively screwed with one of the multiple fixing threaded holes 311 of the adjusting member 30 to adjust the extending length of the rod body 31 of the adjusting member 30.

With reference to FIG. 1, the slide assembly in accordance with the present invention is applied to a stairway 60. According to a distance between two side walls 61 of the stairway 60, the length of the adjusting member 30 extending out of the slide 10 is adjusted, and the two pushing blocks 40 of each one of the pushing units respectively abut the two side walls 61 of the stairway 60. The present invention is securely mounted on the stairway 60 by pushing forces in two opposite directions. Thus, the present invention has enhanced stability and reduces risk of playing on the slide.

Figure 4:
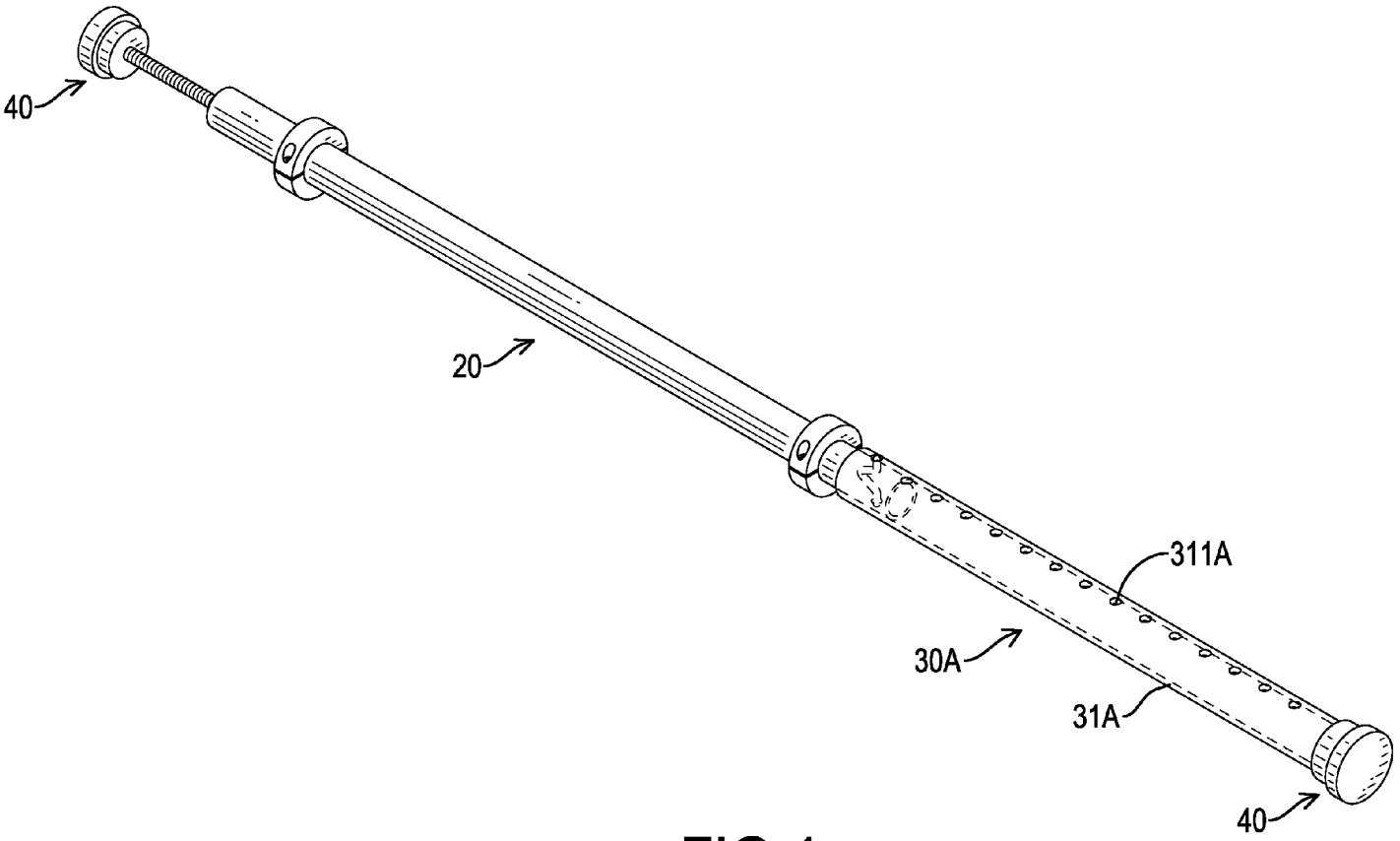
FIG. 4 is a connecting perspective view of a pushing unit of a second embodiment of a slide assembly in accordance with the present invention.
Figure 5:
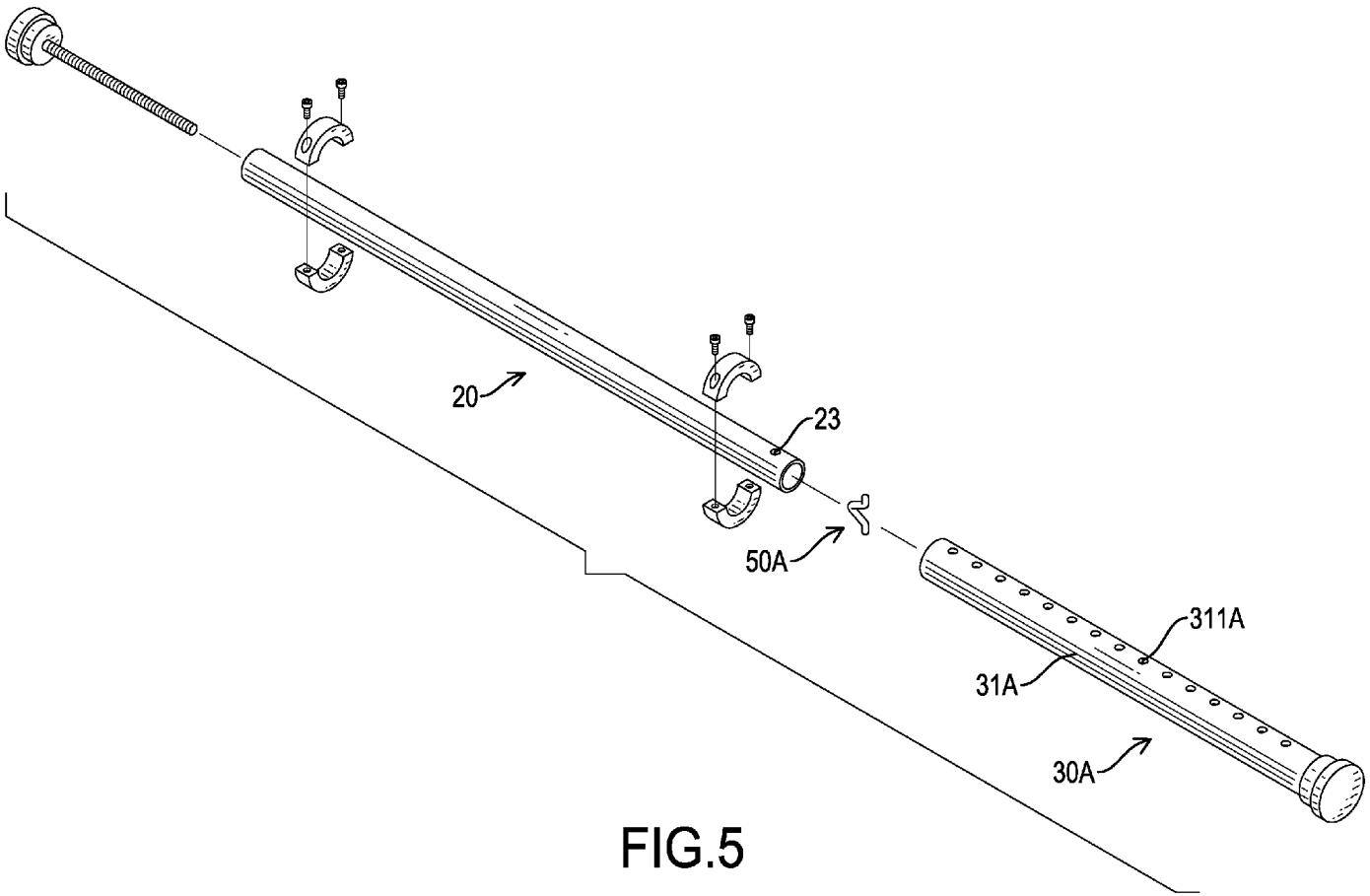
FIG. 5 is an exploded perspective view of the pushing unit of the slide assembly in FIG. 4.

With reference to FIGS. 4 and 5, a second embodiment of a slide assembly in accordance with the present invention is nearly the same as the first embodiment, but the adjusting member 30A has a sleeve 31A. The sleeve 31A of the adjusting member 30A is movably mounted around the connecting member 20 but is incapable of rotating relative to the connecting member 20. In the second embodiment, the multiple fastening portions of the adjusting member 30A are multiple fixing holes 311A spaced from each other, and one of the multiple fixing holes 311A selectively faces the top hole 23 of the connecting member 20. The securing member is mounted in the connecting member 20, is curved and flexible and has a fastening pin 50A. One end of the fastening pin 50A is mounted through the top hole 23 of the connecting member 20 and selectively extends out of said one of the multiple fixing holes 311A of the adjusting member 30A to achieve the securing effect and to determine the extending length of the sleeve 31A. For adjusting the extending length of the sleeve 31A, the fastening pin 50A is forced to separate from one of the fixing holes 311A of the adjusting member 30A, and the sleeve 31A is able to slide relative to the connecting member 20. As the sleeve 31A slides to a corresponding fixing hole 311A, the external force acting on the fastening pin 50A is released and the fastening pin 50A is fastened in the corresponding fixing hole 311A.

Figure 6:
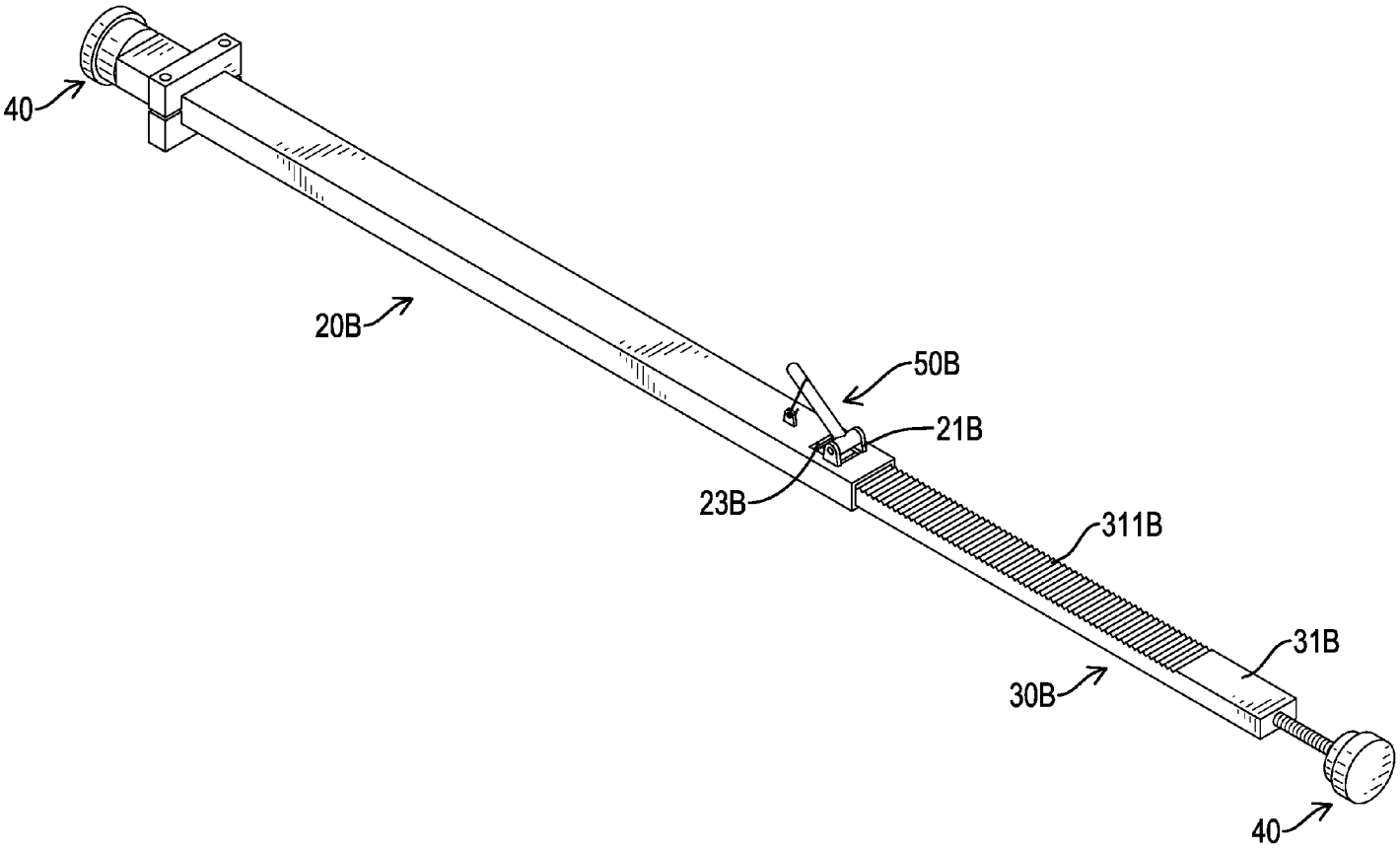
FIG. 6 is a connecting perspective view of a pushing unit of a third embodiment of a slide assembly in accordance with the present invention.
Figure 7:
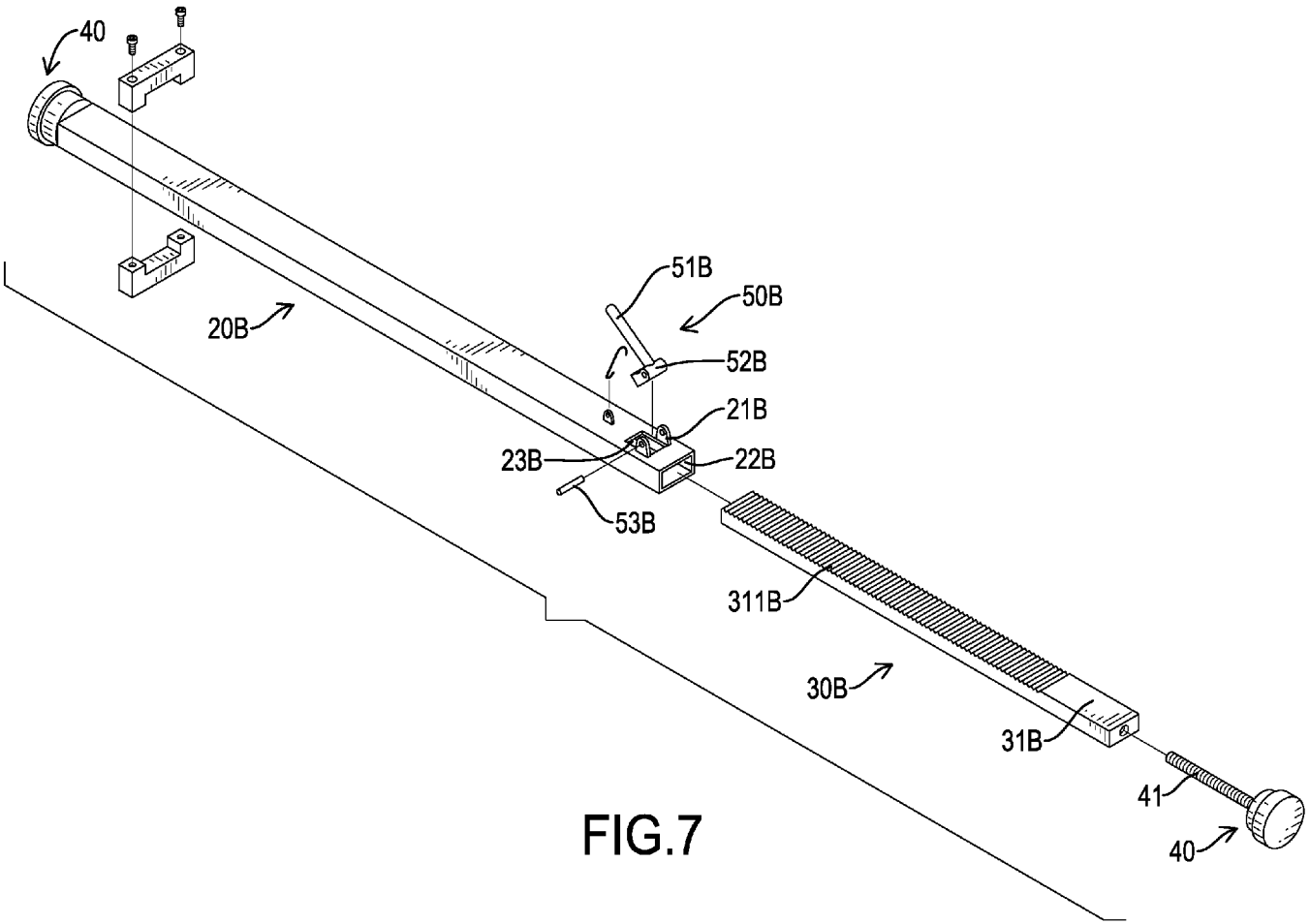
FIG. 7 is an exploded perspective view of the pushing unit of the slide assembly in FIG. 6.

With reference to FIGS. 6 and 7, a third embodiment of a slide assembly in accordance with the present invention is partially the same as the first embodiment, but the pushing unit has a connecting member 20B and an adjusting member 30B. The connecting member 20B is a rectangular sleeve and has a moving passage 22B formed in one of two ends of the connecting member 20B, and a top hole 23B is formed through the connecting member 20B and communicates with the moving passage 22B. The connecting member 20B has two pivoting sheets 21B formed oppositely on two sides of the top hole 23B. The adjusting member 30B has a rod body 31B movably mounted in the moving passage 22B of the connecting member 20B but is incapable of rotating relative to the moving passage 22B and has multiple fastening portions spaced from each other. In the third embodiment, the multiple fastening portions are multiple tooth portions 311B, and one of the tooth portions 311B selectively faces the top hole 23B of the connecting member 20B.

The securing member includes an engaging component 50B and a hooking component. The engaging component 50B has a grab handle 51B, an engaging portion 52B, and pivoting shaft 53B. The engaging portion 52B is connected to the grab handle 51B and is disposed between the two pivoting sheets 21B of the connecting member 20B. The pivoting shaft 53B is mounted through the two pivoting sheets 21B and the engaging portion 52B, and the engaging portion 52B is pivotally rotatable relative to the two pivoting sheets 21B and engages with said one of the tooth portions 311B of the adjusting member 30B to determine the extending length of the rod body 31B. Two ends of the hooking component are respectively hooked on the connecting member 20B and the grab handle 51B of the engaging component 50B to prevent the engaging portion 52B from rotating and separating from the tooth portions 311B of the adjusting member 30B.

Figure 8:
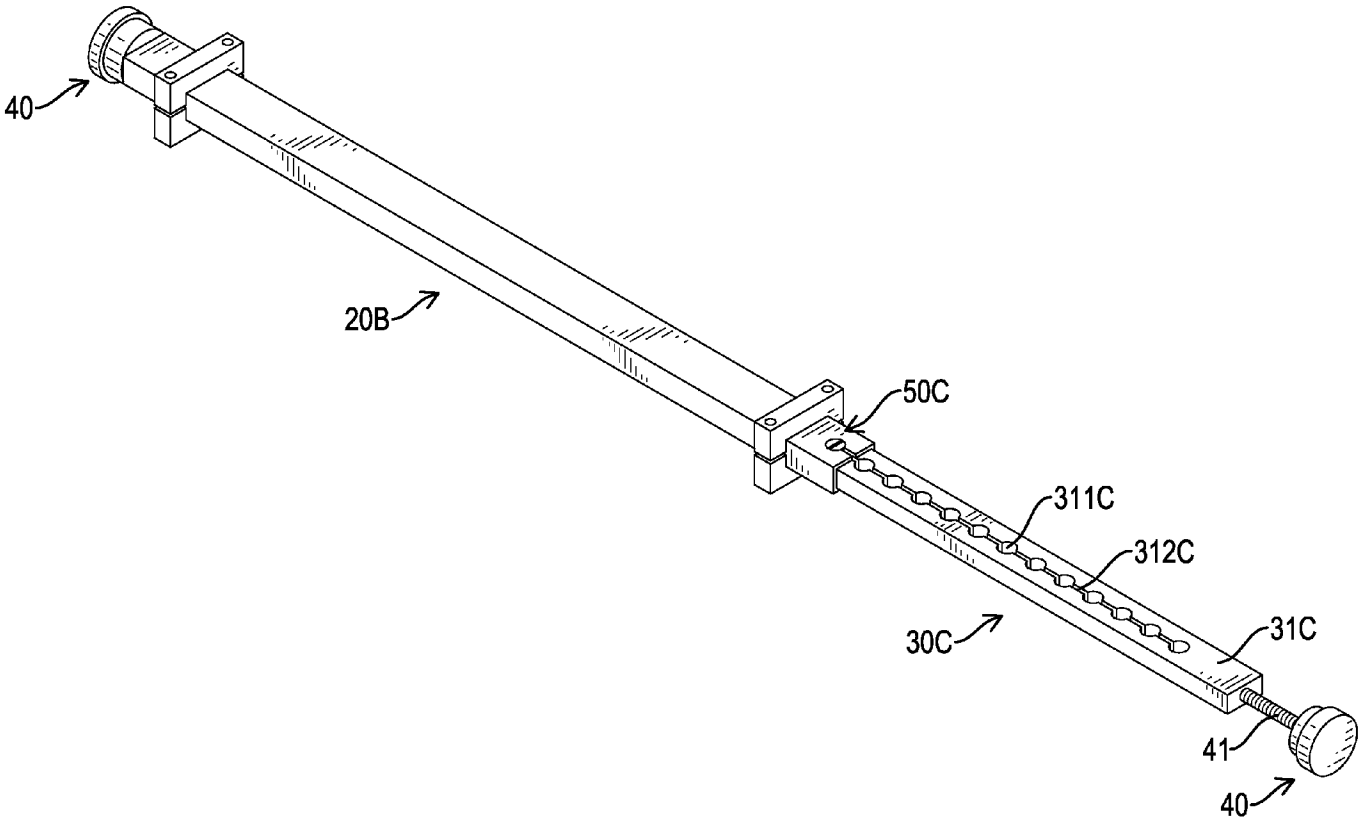
FIG. 8 is a connecting perspective view of a pushing unit of a fourth embodiment of a slide assembly in accordance with the present invention.
Figure 9:
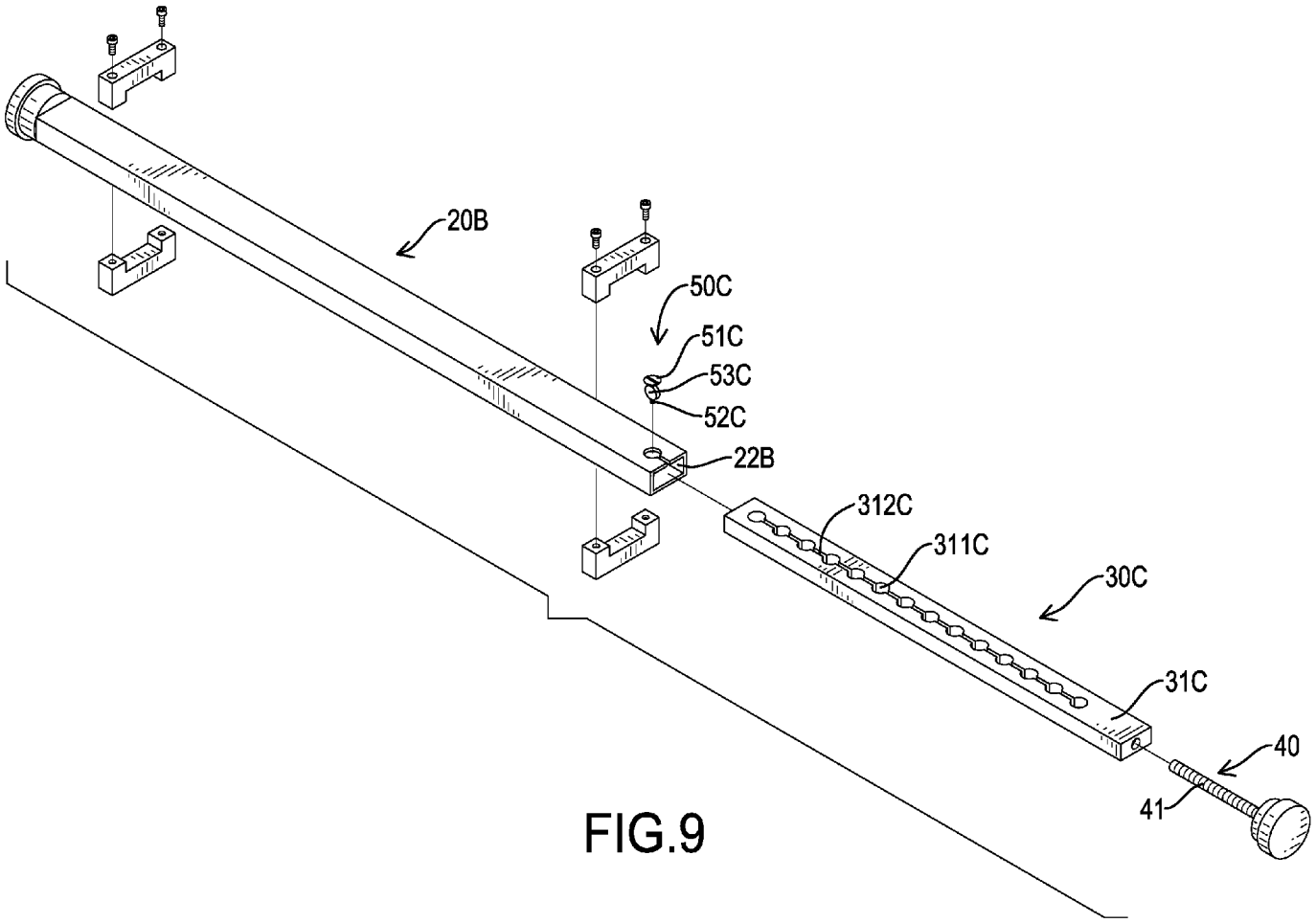
FIG. 9 is an exploded perspective view of the pushing unit of the slide assembly in FIG. 8.

With reference to FIGS. 8 and 9, a fourth embodiment of a slide assembly in accordance with the present invention is partially the same as the third embodiment, but the pushing unit has a connecting member 20B and an adjusting member 30C. The adjusting member 30C has a rod body 31C movably mounted in the moving passage 22B of the connecting member 20B but is incapable of rotating relative to the moving passage 22B and has multiple fastening portions spaced from each other. In the fourth embodiment the multiple fastening portions are multiple fastening holes 311C, multiple through openings 312C are formed between any two adjacent fastening holes 311C, and one of the multiple fastening holes 311C selectively faces the top hole 23B of the connecting member 20B.

The securing member is a circular fastening component 50C and has an operating piece, a turning rod 52C connected to the operating piece and mounted in the connecting member 20B, and a fastening portion 53C. The operating piece of the circular fastening component 50C is a turning disc 51C, and the turning disc 51C is rotatably mounted on the connecting member 20B and has a groove 511C formed on a top surface of the turning disc 51C. The turning rod 52C is formed on a bottom surface of the turning disc 51C and is mounted in the connecting member 20B. The fastening portion 53C is securely mounted on the turning rod 52C and is selectively fastened with said one of the fastening holes 311C of the adjusting member 30C. In the fourth embodiment the fastening portion 53C is a plate and a thickness of the fastening portion 53C is equal to or smaller than a size of any one of the through openings 312C of the rod body 31C. For adjusting the extending length of the rod body 31C, the turning disc 51C is rotated to make the fastening portion 53C face all the through openings 312C, and the rod body 31C can slide along the fastening portion 53C to determine the extending length of the rod body 31C.

Figure 10:
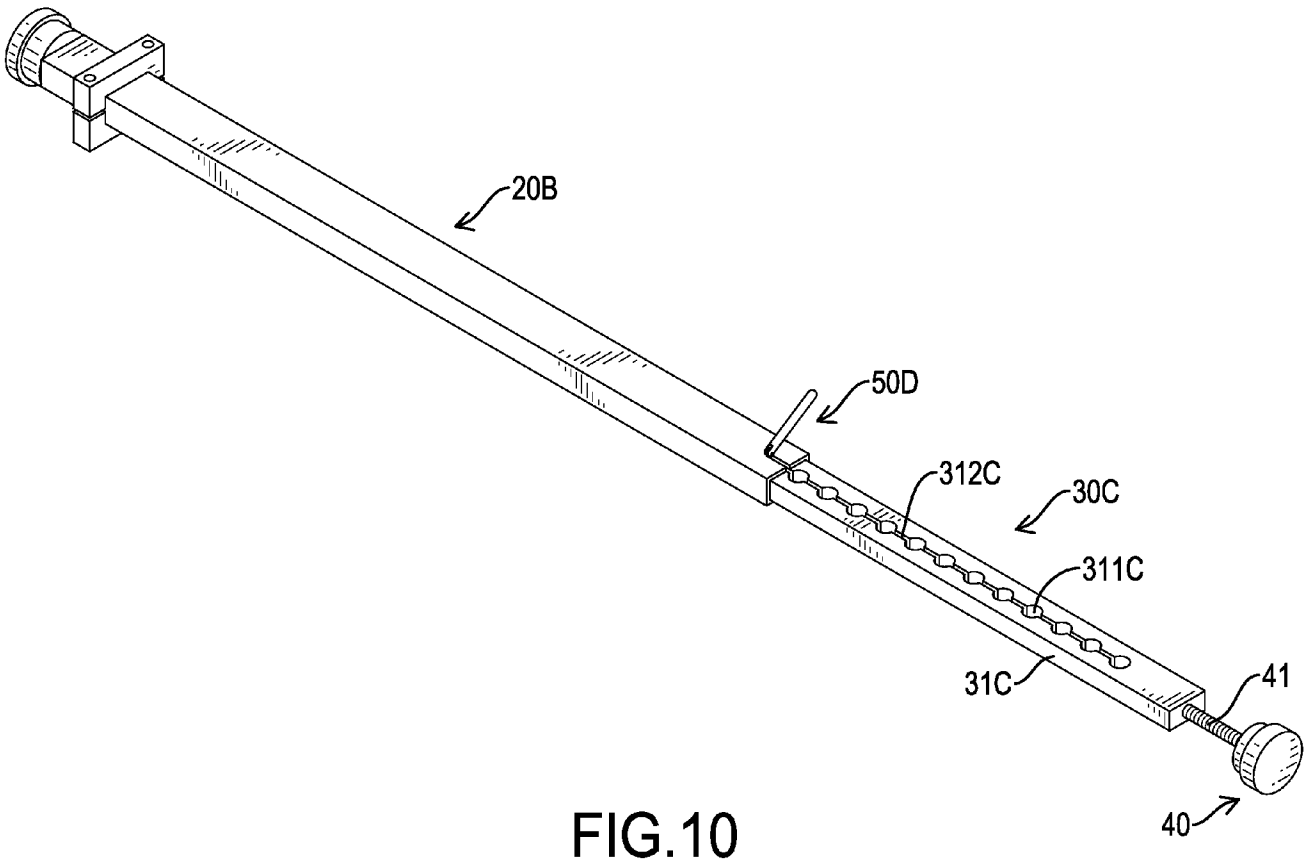
FIG. 10 is a connecting perspective view of a pushing unit of a fifth embodiment of a slide assembly in accordance with the present invention.
Figure 11:
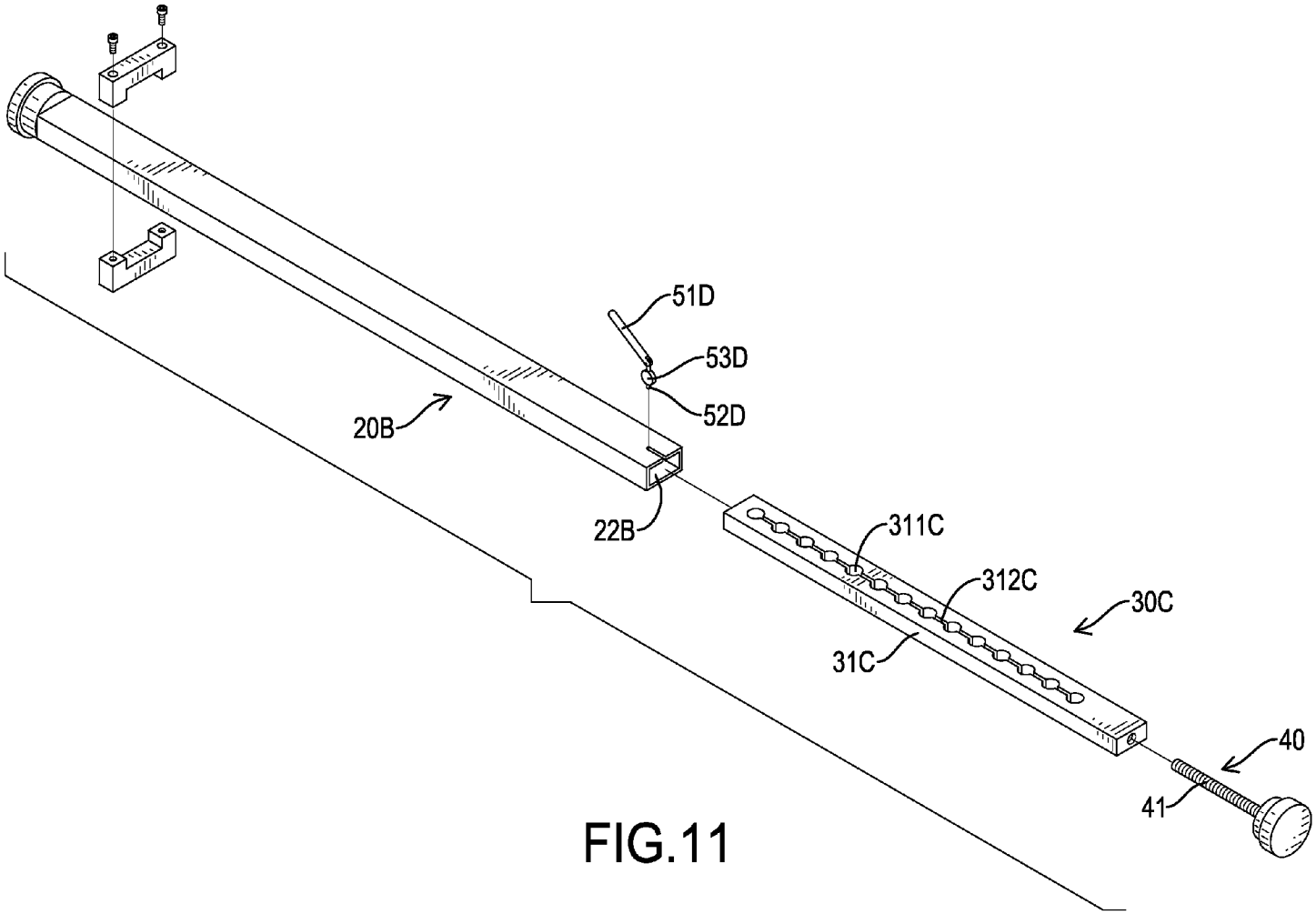
FIG. 11 is an exploded perspective view of the pushing unit of the slide assembly in FIG. 10.

With reference to FIGS. 10 and 11, a fifth embodiment of a slide assembly in accordance with the present invention is nearly the same as the fourth embodiment, but the pushing unit has a connecting member 20B and an adjusting member 30C. The securing member is a circular fastening component 50D and has an operating piece, a turning rod 52D, and a fastening portion 53D. The operating piece of the circular fastening component 50D is a twisting rod 51D, and the twisting rod 51D is rotatably mounted on the connecting member 20B. The turning rod 52D is connected to a bottom surface of the twisting rod 51D and is mounted in the connecting member 20B. The fastening portion 53D is securely mounted on the turning rod 52D and is selectively fastened with one of the fastening holes 311C of the adjusting member 30C. In the fifth embodiment, the fastening portion 53D is a plate and a thickness of the fastening portion 53D is equal to or smaller than a size of any one of the through openings 312C of the rod body 31C. For adjusting the extending length of the rod body 31C, the twisting rod 51D is rotated to make the fastening portion 53D face all the through openings 312C, and the rod body 31C can slide along the fastening portion 53D to determine the extending length of the rod body 31C.

Figure 12:
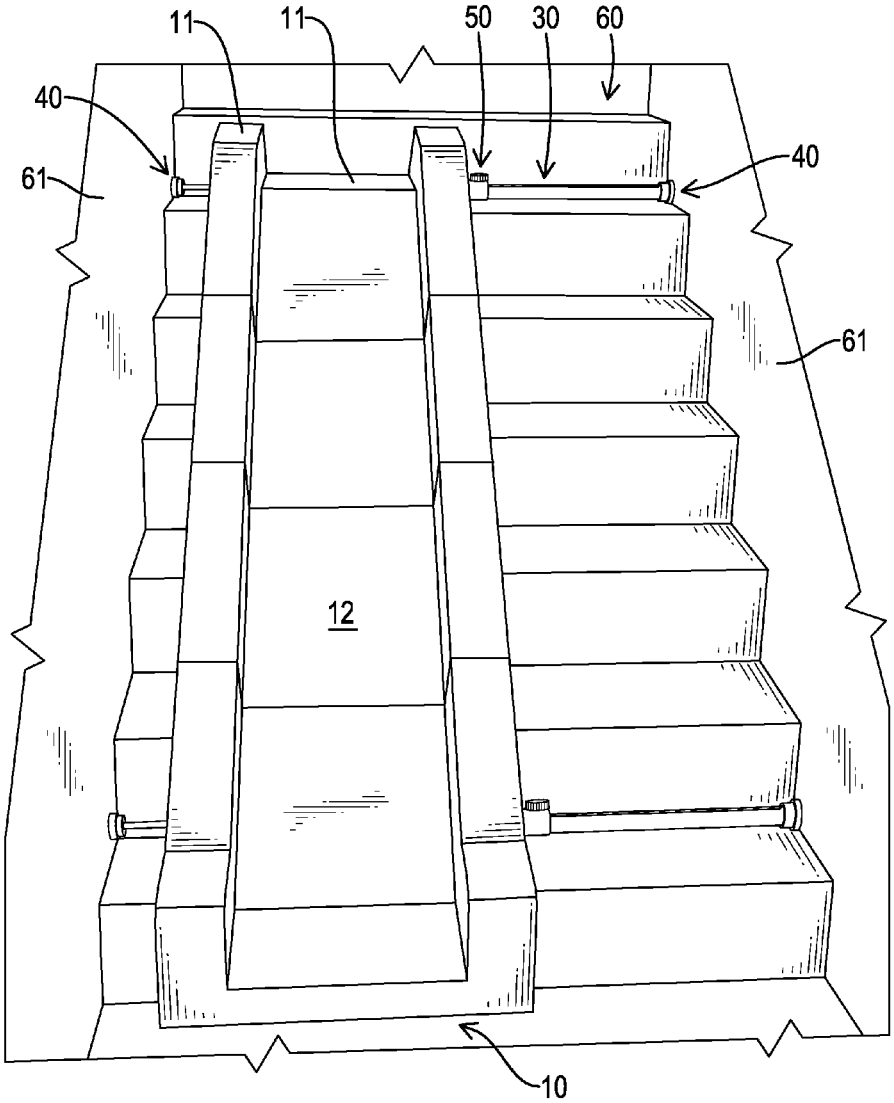
FIG. 12 is another embodiment of a slide assembly in accordance with the present invention.

With reference to FIG. 12, in another preferred embodiment, the present invention further has two pushing units, and the two pushing units are securely mounted in the platform 11 and the sliding section 12 of the slide 10 respectively. The two pushing blocks 40 of each pushing unit respectively abut on two opposite side walls 61 of the stairway 60, and the stability of the present invention is further strengthened by the securing effect of the two pushing units.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A slide assembly comprising:

a slide having a platform and a sliding section, and the sliding section connected to the platform; and at least one pushing unit connected to the slide and having a connecting member securely mounted in the slide and two ends of the connecting member respectively extending out of the slide, the connecting member having a moving passage formed in one of the two ends of the connecting member; and a top hole formed through the connecting member and communicating with the moving passage;

an adjusting member movably mounted in the moving passage of the connecting member but incapable of rotating relative to the moving passage and having multiple fastening portions, wherein the multiple fastening portions of the adjusting member are multiple tooth portions spaced from each other, and one of the tooth portions selectively faces the top hole of the connecting member; and two pushing blocks respectively connected to an outer end of the connecting member and an outer end of the adjusting member; and a securing member connected to the connecting member and selectively fastened with one of the tooth portions of the adjusting member, the securing member having an engaging component having a grab handle; and an engaging portion connected to the grab handle and pivotally mounted on the connecting member, and the engaging portion selectively engaging with said one of the tooth portions of the adjusting member; and a hooking component, two ends of the hooking component respectively hooking on the connecting member and the grab handle of the engaging component to prevent the engaging portion rotating and separating from the tooth portions of the adjusting member.

2. A slide assembly comprising:

a slide having a platform and a sliding section, and the sliding section connected to the platform; and at least one pushing unit connected to the slide and having a connecting member securely mounted in the slide and two ends of the connecting member respectively extending out of the slide, the connecting member having a moving passage formed in one of the two ends of the connecting member; and an adjusting member movably mounted in the moving passage of the connecting member but incapable of rotating relative to the moving passage and having multiple fastening portions, wherein the multiple fastening portions of the adjusting member are multiple fastening holes spaced from each other, and multiple through openings are respectively formed between any two adjacent fastening holes; and two pushing blocks respectively connected to an outer end of the connecting member and an outer end of the adjusting member; and a securing member connected to the connecting member and selectively fastened with one of the fastening holes of the adjusting member, the securing member being a circular fastening component and having an operating piece;

a turning rod connected to the operating piece and mounted in the connecting member; and a fastening portion being a plate, securely mounted on the turning rod, selectively fastened with said one of the fastening holes of the adjusting member, and selectively passed through the through opening between any two adjacent fastening holes.

3. The slide assembly as claimed in claim 2, wherein the operating piece of the circular fastening component is a turning disc, the turning disc is rotatably mounted on the connecting member and has a groove formed on a top surface of the turning disc, and the turning rod of the securing member is formed on a bottom surface of the turning disc.

4. The slide assembly as claimed in claim 2, wherein the operating piece of the circular fastening component is a twisting rod, the twisting rod is rotatably mounted on the connecting member, and the turning rod of the securing member is formed on a bottom end of the twisting rod.

5. The slide assembly as claimed in claim 4, wherein the number of the at least one pushing unit is one, and the pushing unit is securely mounted through the platform of the slide.

6. The slide assembly as claimed in claim 4, wherein the number of the at least one pushing unit is two, and the two pushing units are securely mounted through the platform and the sliding section of the slide respectively.

7. The slide assembly as claimed in claim 4, wherein at least one of the pushing blocks of the each one of the at least one pushing unit has a screw rod, the screw rod is perpendicularly and securely mounted on a side wall of the pushing block, and the pushing block is screwed with the connecting member or the adjusting member.

* * * * *